US006021778A

United States Patent [19]

Garofalo

[11] Patent Number: 6,021,778

[45] Date of Patent: Feb. 8, 2000

[54] REGULATOR FOR UNDERWATER BREATHING APPARATUS

[75] Inventor: Giovanni Garofalo, Rapallo, Italy

[73] Assignee: HTM SPORT S.p.A., Rapallo, Italy

[21] Appl. No.: 08/949,846

[22] Filed: Oct. 14, 1997

[30] Foreign Application Priority Data

Oct. 23, 1996 [IT] Italy ..... GE960033 U

[51] Int. Cl.[7] ..... A63C 11/02; A62B 18/10; A62B 9/02; A61M 16/00

[52] U.S. Cl. ..... 128/204.26; 128/201.27; 128/201.28; 128/205.24

[58] Field of Search ..... 128/205.24, 204.26, 128/201.28, 201.27

[56] References Cited

U.S. PATENT DOCUMENTS

| | | | |
|---|---|---|---|
| 2,441,216 | 5/1948 | Wiggins . | |
| 3,054,414 | 9/1962 | Blackwell . | |
| 4,219,017 | 8/1980 | Shamlian et al. . | |
| 5,501,213 | 3/1996 | Jackson | 128/204.26 |
| 5,503,142 | 4/1996 | Semeia | 128/204.26 |

FOREIGN PATENT DOCUMENTS

| | | |
|---|---|---|
| 1570065 | 6/1980 | United Kingdom . |
| 2233237 | 1/1991 | United Kingdom . |

*Primary Examiner*—John G. Weiss
*Assistant Examiner*—Todd M. Martin
*Attorney, Agent, or Firm*—Fattibene & Fattibene; Paul A. Fattibene; Arthur T. Fattibene

[57] ABSTRACT

Regulator for underwater breathing apparatus, comprising a box-like body containing the device that regulates the admission of air from the first reducing stage, fitted with a mouthpiece through which the air is inhaled and an outlet through which the exhaled air is discharged, the air-regulating device comprising a chamber in which the regulating valve is located and chamber that communicates with the surrounding water, the chambers being separated by a diaphragm that controls the regulating valve, with the chamber that communicates with the surrounding water being delimited by the diaphragm and by a wall provided with plurality of a apertures; the apertures are provided with a grid-like element that break up the flow of fluid through the latter.

10 Claims, 2 Drawing Sheets

REGULATOR FOR UNDERWATER BREATHING APPARATUS

BACKGROUND AND SUMMARY OF THE INVENTION

The present invention relates to underwater breathing apparatus, and in particular to regulators for underwater breathing apparatus.

Regulator devices are known which comprise a box-like body containing the device that regulates the admission of air from the first reducing stage, fitted with a mouthpiece through which the said air is inhaled and an outlet through which the exhaled air is discharged, the air-regulating device comprising a chamber in which the regulating valve is located and a chamber that communicates with the surrounding water, the chambers being separated by a diaphragm that controls the regulating valve. The chamber that communicates with the surrounding water is generally delimited by the diaphragm and by a wall, usually consisting of a removable cover, provided with a plurality of apertures through which the water enters the chamber.

Regulators of the above described kind are known for instance from U.S. Pat. Nos. 2,441,216; 2,878,807; 4,219,017; FR 120 535 and GB 1,570,065.

With regulators of this type, when the diver is moving at speed through the water for any length of time, or when there are strong currents, the water pressure generated by the speed of the movement may spuriously deflect the diaphragm through the apertures in the cover, causing the regulating valve to be activated erroneously and therefore, in the final analysis, wasting breathable air.

The object of the present invention is therefore to provide a regulator in which the water entering the chamber that communicates with the surrounding water is able to generate, inside the chamber, a pressure consistent with the ambient pressure, but not adversely affected by the diver's movements.

From U.S. Pat. No. 3,054,414 an underwater regulator is known provided with a grid positioned in correspondence of the outlet, or exhalation opening of the regulator (see column 2, lines 9 to 12). The scope of the presence of this grid is not explained in said patent, but obviously its scope is not the same as the scope of the present invention.

Finally, from GB 2,233,237 a valve arrangement for controlling air supply to the facial cavity for a safety breathing apparatus is shown, provided with a dust cover provided with a cylindrical wall having apertures each covered by a filter (See page 8, lines 34 and 35 and page 9, lines 1 to 5). Again the scope of said device is quite different from the scope of the invention.

The subject of the present invention is therefore a regulator comprising a box-like body containing the device that regulates the admission of air from the first reducing stage, fitted with a mouthpiece through which the air is inhaled and an outlet through which the exhaled air is discharged, the air-regulating device comprising a chamber in which the regulating valve is located and a chamber that communicates with the surrounding water, the chambers being separated by a diaphragm that controls the regulating valve, with the chamber that communicates with the surrounding water being delimited by the diaphragm and by a wall provided with a plurality of apertures, characterized in that the apertures are provided with means that break up the flow of fluid through the latter.

Advantageously, the break-up means comprise grill elements, made of plastic or metal, attached to the individual aperture or, alternatively, a single wall of grill material that is able to control all the apertures.

BRIEF DESCRIPTION OF THE DRAWINGS

Additional advantages and characteristics will become more apparent on reading the following description of an embodiment of the present invention, which description is given by way of a non-limiting example for illustrative purposes, with reference to the appended drawings in which.

DESCRIPTION OF THE PREFERRED EMBODIMENT

Figure 1:
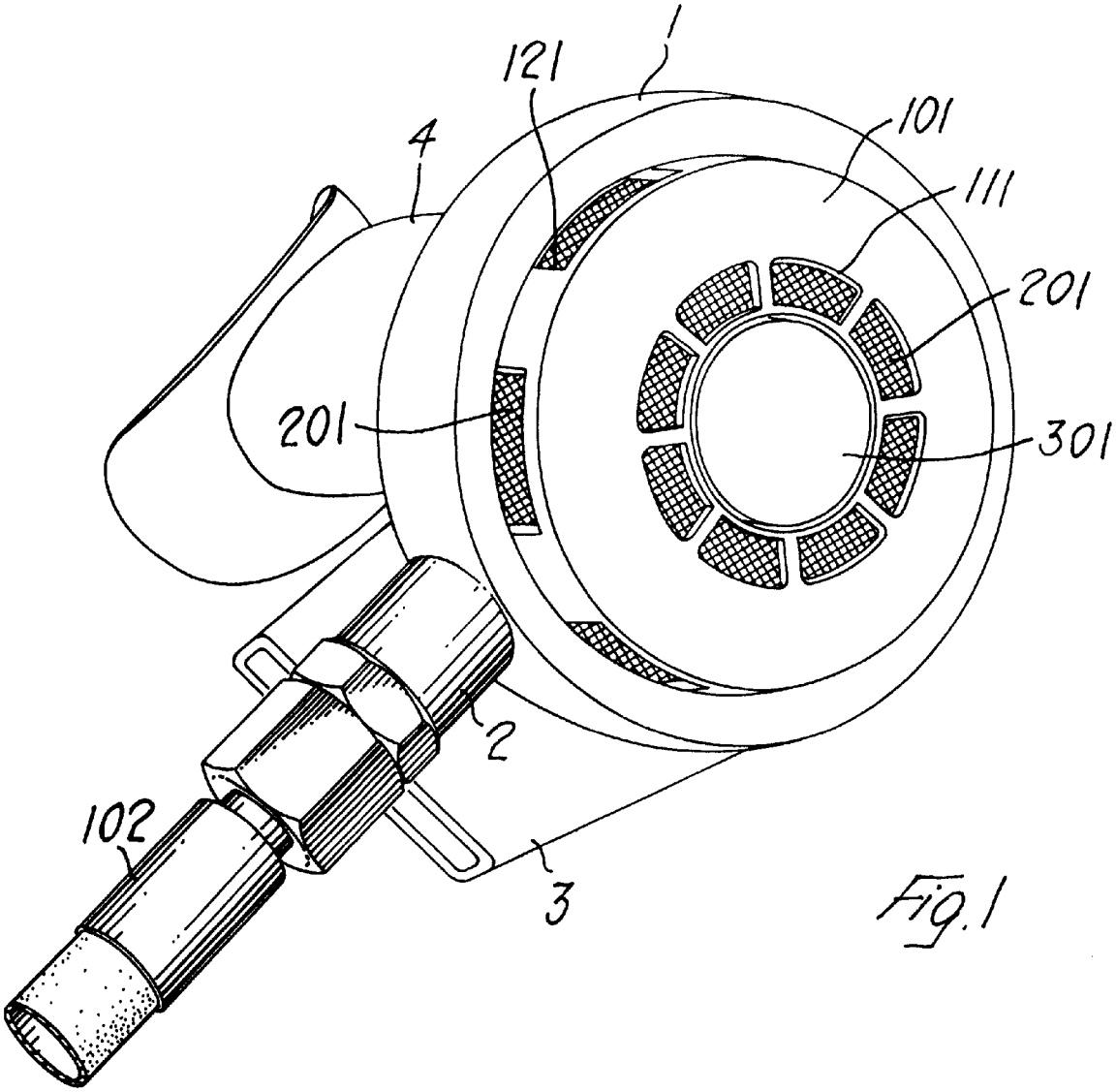
FIG. 1 is a perspective view of the regulator according to the invention.

FIG. 1 shows a regulator according to the invention, with the reference number 1 denoting the box-like body of the regulator. Connected to this body are a mouthpiece 4, a discharge outlet 3 and an air-intake pipe 2 connected via the hose 102 to the first stage of the breathing apparatus, not shown in the figure. The box-like body 1 comprises a cover 101 into which the purge button 301, known per se and illustrated in greater detail below, is inserted axially. The cover 101 has a plurality of radial openings 121 and a plurality of axial openings 111, through which the grille 201 can be seen.

Figure 2:
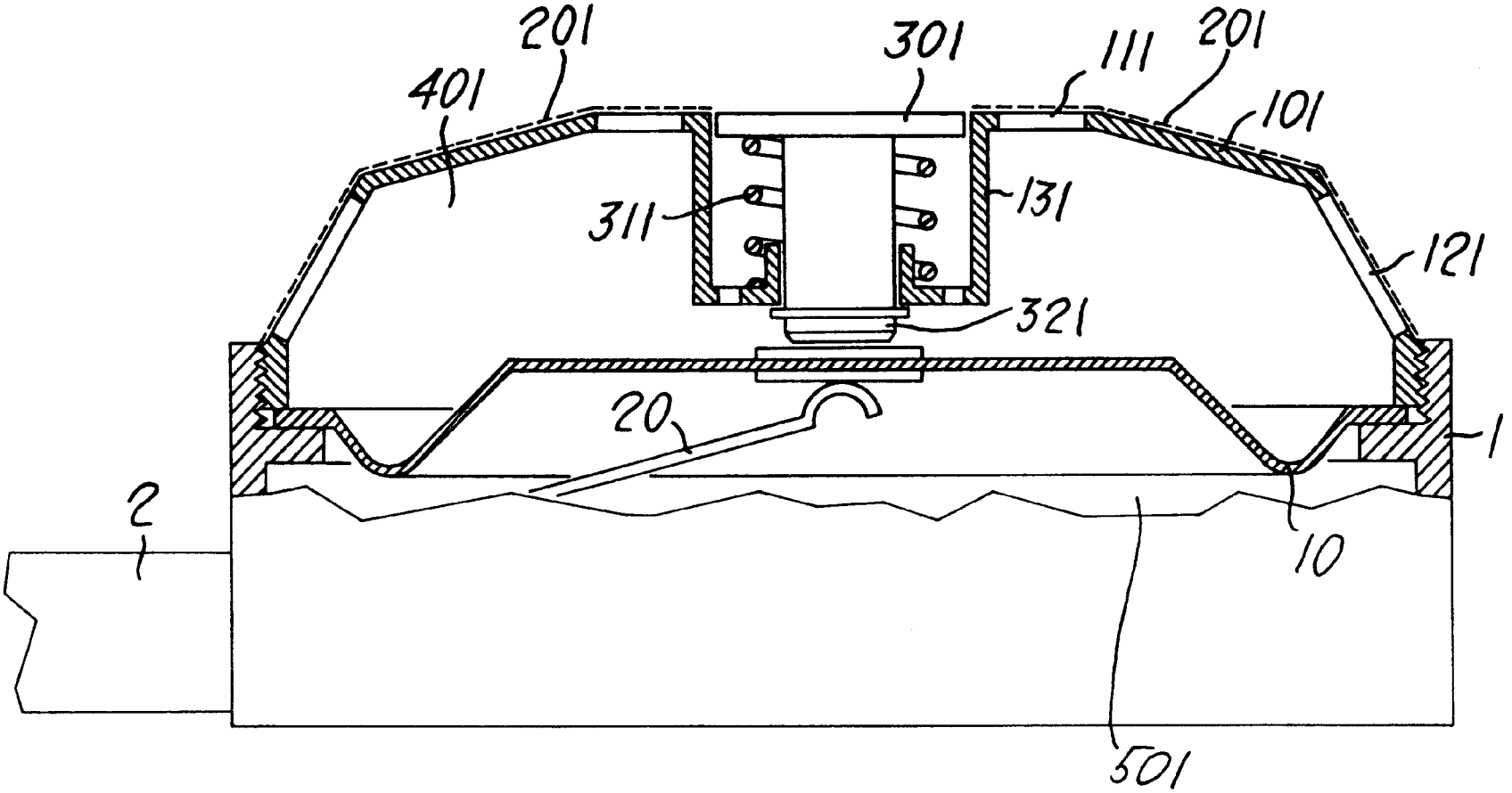
FIG. 2 is a view, in partial longitudinal section, of a variant embodiment of the regulator according to the invention.

FIG. 2 shows a variant embodiment of the regulator according to the invention, in longitudinal section. The same reference numerals have been used for similar parts. The figure shows the purge button 301 fitted with the elastic-return spring 311, which button enables a pressure to be exerted via its end 321 on the diaphragm 10 that controls the lever 20 of the air-regulating valve, in a way known per se and therefore not described in greater detail. This diaphragm 10 separates the chamber 401, delimited by the cover 101 and communicating with the surrounding water via the above-mentioned openings 121 in the cover, and the chamber 501 in which the regulating valve is located. In the variant embodiment illustrated in this figure, the grill 201, in the shape of a continuous spherical segment, is located adjacent to the external surface of the cover 101.

The following text describes how the regulator according to the invention works. As is known, regulators of the type described above allow the inflow of air to the mouthpiece 4 to be regulated such that the influence of the external pressure is taken into account. To this end, the diaphragm 10 is located in a chamber that communicates with the surrounding water. However, as already mentioned above, the diver's movement may accentuate the effects of the external pressure—even to a very considerable degree—on account of the flows that are set up through the openings, in particular through the axial openings 111, and that act on the diaphragm. By inserting a grill 201 next to the apertures, these flows are broken up, thereby minimizing the above-mentioned drawback. The pressure generated by the water inside the chamber 401 is thus solely dependent on the diver's depth and is not adversely affected by the diver's speed. As shown in FIG. 2, the grill still fulfills the function described even if it is located outside the cover 121.

Of course, the flow break-up means can comprise the grill as illustrated and described, but may also comprise grill elements that are attached directly to each aperture in the cover 101, such as break-up elements made integrally with the cover, that is to say so that the surface of the apertures in the cover of the regulator's box-like body are formed by a or in a similar manner.

The regulator produced in this way overcomes the drawbacks of known devices of the prior art, enabling the pressure of the gas delivered to be effectively corrected with respect to the external pressure, with the effects due to the diver's speed of movement having been eliminated from the latter.

I claim:

1. A regulator for an underwater breathing apparatus, comprising a box-like body containing a device that regulates the admission of air from a first reducing stage, fitted with a mouthpiece through which the air is inhaled and an outlet through which the exhaled air is discharged, the regulator comprising a first chamber in which a regulating valve is located and a second chamber that communicates with the surrounding water, said first and second chambers being separated by a diaphragm that controls the regulating valve, with said second chamber that communicates with the surrounding water being delimited by said diaphragm and by a wall provided with a plurality of apertures, in which said plurality of apertures are provided with means that break up the flow of fluid through said plurality of apertures, and in which said means for breaking up the flow comprises a plurality of grill elements located in each of said plurality of apertures in said wall.

2. The regulator according to claim 1, in which said grill elements are attached to said plurality of apertures.

3. The regulator according to claim 1, in which said grill elements are formed integrally with said wall.

4. A regulator for an underwater breathing apparatus, comprising a box-like body containing a device that regulates the admission of air from a first reducing stage, fitted with a mouthpiece through which the air is inhaled and an outlet through which the exhaled air is discharged, the regulator comprising a first chamber in which a regulating valve is located and a second chamber that communicates with the surrounding water, said first and second chambers being separated by a diaphragm that controls the regulating valve, with said second chamber that communicates with the surrounding water being delimited by said diaphragm and by a wall provided with a plurality of apertures, in which said plurality of apertures are provided with means that break up the flow of fluid through said plurality of apertures, and in which said means for breaking up the flow comprises a continuous grill element that is located adjacent to an internal surface of said wall delimiting said second chamber and is securely attached to said wall.

5. A regulator for an underwater breathing apparatus, comprising a box-like body containing a device that regulates the admission of air from a first reducing stage, fitted with a mouthpiece through which the air is inhaled and an outlet through which the exhaled air is discharged, the regulator comprising a first chamber in which a regulating valve is located and a second chamber that communicates with the surrounding water, said first and second chambers being separated by a diaphragm that controls the regulating valve, with said second chamber that communicates with the surrounding water being delimited by said diaphragm and by a wall provided with a plurality of apertures, in which said plurality of apertures are provided with means that break up the flow of fluid through said plurality of apertures, and in which said means for breaking up the flow comprises a continuous grill element that is located adjacent to an external surface of said wall delimiting said second chamber and is securely attached to said wall.

6. A regulator for an underwater breathing apparatus comprising:

a body;

a regulator chamber formed by said body;

a regulator valve positioned in said regulator chamber;

a cover attached to said body, said cover having a plurality of apertures therein;

a fluid chamber formed by said cover;

a diaphragm separating said regulator chamber from said fluid chamber; and means, associated with said plurality of apertures, for breaking up flow of a liquid so that pressure generated by the liquid is solely dependent upon underwater depth, whereby the effects due to fluid flow are eliminated.

7. A regulator for an underwater breathing apparatus comprising:

a body;

a regulator chamber formed by said body;

a regulator valve positioned in said regulator chamber;

a cover attached to said body, said cover having a plurality of apertures therein;

a fluid chamber formed by said cover;

a diaphragm separating said regulator chamber from said fluid chamber; and a plurality of grill elements, one of each of said plurality of grill elements located in each of said plurality of apertures, said plurality of grill elements breaking up flow of a liquid so that pressure generated by the liquid is solely dependent upon underwater depth, whereby the effects due to fluid flow are eliminated.

8. A regulator for an underwater breathing apparatus as in claim 7 wherein:

said plurality of grill elements are formed integrally within said cover.

9. A regulator for an underwater breathing apparatus as in claim 7 wherein:

said plurality of grill elements are formed on an inside surface of said cover.

10. A regulator for an underwater breathing apparatus as in claim 7 wherein:

said plurality of grill element are formed on an outside surface of said cover.

* * * * *